US010933460B2

(12) United States Patent
Deng et al.

(10) Patent No.: US 10,933,460 B2
(45) Date of Patent: Mar. 2, 2021

(54) WIRE PROCESSING APPARATUS

(71) Applicants: Tyco Electronics (Shanghai) Co. Ltd., Shanghai (CN); TE Connectivity Corporation, Berwyn, PA (US); Measurement Specialties (Chengdu) Ltd., Chengdu (CN); Shenzhen AMI Technology Co. Ltd, Shenzhen (CN)

(72) Inventors: Yingcong Deng, Shanghai (CN); Lan Gong, Chengdu (CN); Qian Ying, Chengdu (CN); Dandan Zhang, Shanghai (CN); Lvhai Hu, Shanghai (CN); Yun Liu, Shanghai (CN); Qinglong Zeng, Shenzhen (CN); Yong Yan, Chengdu (CN); Roberto Francisco-Yi Lu, Bellevue, WA (US)

(73) Assignees: Tyco Electronics (Shanghai) Co. Ltd., Shanghai (CN); TE Connectivity Corporation, Berwyn, PA (US); Measurement Specialties (Chengdu) Ltd, Chengdu (CN); Shenzhen AMI Technology Co., Ltd., Shenzhen (CN)

( * ) Notice: Subject to any disclaimer, the term of this patent is extended or adjusted under 35 U.S.C. 154(b) by 279 days.

(21) Appl. No.: 16/026,584

(22) Filed: Jul. 3, 2018

(65) Prior Publication Data

US 2019/0009326 A1 Jan. 10, 2019

(30) Foreign Application Priority Data

Jul. 4, 2017 (CN) ..... 201710538400.1

(51) Int. Cl.
*B23P 19/00* (2006.01)
*B21F 1/02* (2006.01)

(52) U.S. Cl.
CPC ..... *B21F 1/026* (2013.01)

(58) Field of Classification Search
CPC ..... B21F 1/02; B21F 1/026
See application file for complete search history.

(56) References Cited

U.S. PATENT DOCUMENTS 5,088,312 A * 2/1992 Lange ..... B21F 5/00 72/420
5,535,497 A * 7/1996 Huang ..... H01R 43/16 29/33 F
5,921,160 A * 7/1999 Yankaitis ..... B21F 1/026 140/140
6,000,656 A * 12/1999 Taylor ..... B21C 1/02 242/365.7
6,705,355 B1 * 3/2004 Wiesenfeld ..... B21F 1/026 140/140
2001/0047730 A1 * 12/2001 Otani ..... H01R 43/28 101/37
2002/0129689 A1 * 9/2002 Kern ..... B23D 23/00 83/364
2015/0290736 A1 * 10/2015 Zhang ..... B23K 26/1476 219/56.22

* cited by examiner

*Primary Examiner* — Paul D Kim
(74) *Attorney, Agent, or Firm* — Barley Snyder

(57) ABSTRACT

A wire processing apparatus comprises a frame, a clamping device mounted on the frame and adapted to clamp a wire to be processed, and a straightening and cutting device mounted on the frame. The straightening and cutting device is adapted to press a conductor of the wire into a straight shape and cut the conductor to a predetermined length after pressing.

20 Claims, 4 Drawing Sheets

WIRE PROCESSING APPARATUS

CROSS-REFERENCE TO RELATED APPLICATION

This application claims the benefit of the filing date under 35 U.S.C. § 119(a)-(d) of Chinese Patent Application No. 201710538400.1, filed on Jul. 4, 2017.

FIELD OF THE INVENTION

The present invention relates to a wire processing apparatus and, more particularly, to a wire processing apparatus adapted to straighten a conductor exposed from an end of a wire and cut the straightened conductor into a predetermined length.

BACKGROUND

In manufacturing an electronic device, it is often necessary to weld a wire to a circuit board or to another wire. Before welding, it is necessary to perform some processes on the end of the wire. For example, an outer insulation layer at an end of the wire is first removed to expose a segment of conductor. Next, the exposed conductor is straightened by a special tool or apparatus. Lastly, the straightened conductor is cut into a predetermined length. After completing the above processes, subsequent welding operations for the wire may be performed.

The end of the wire is usually processed manually before welding. For example, an operator first strips off the outer insulation layer at the end of the wire by a stripping tool. Next, the operator straightens the exposed conductor with a straightening tool. Lastly, the operator cuts the straightened conductor into a predetermined length with a cutter. It is, however, very time-consuming and inefficient to process the end of the wire manually. Furthermore, the quality of manual straightening and cutting is not guaranteed, which reduces the welding quality of the wire.

SUMMARY

A wire processing apparatus comprises a frame, a clamping device mounted on the frame and adapted to clamp a wire to be processed, and a straightening and cutting device mounted on the frame. The straightening and cutting device is adapted to press a conductor of the wire into a straight shape and cut the conductor to a predetermined length after pressing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
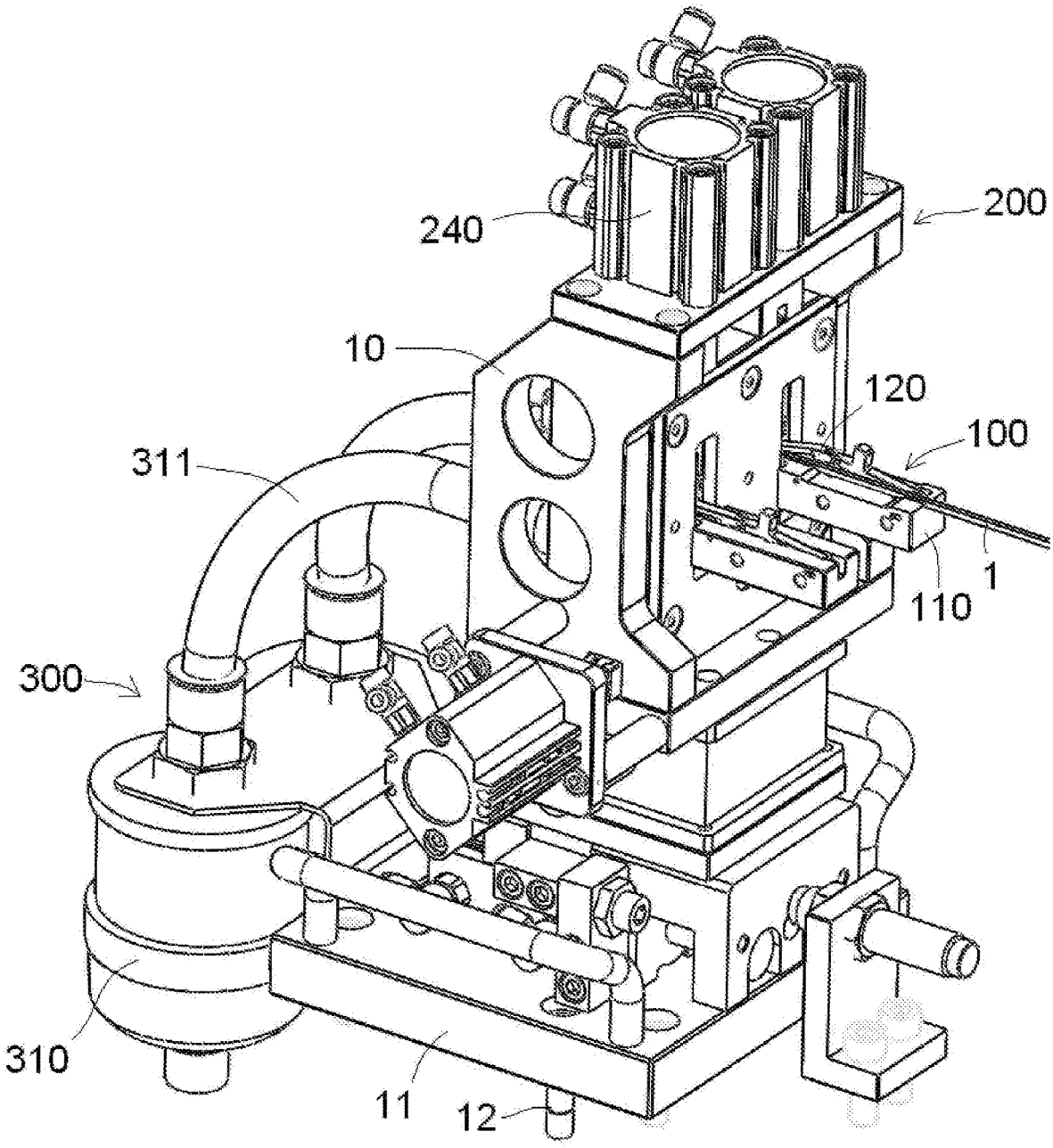
FIG. 1 is a perspective view of a wire processing apparatus according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
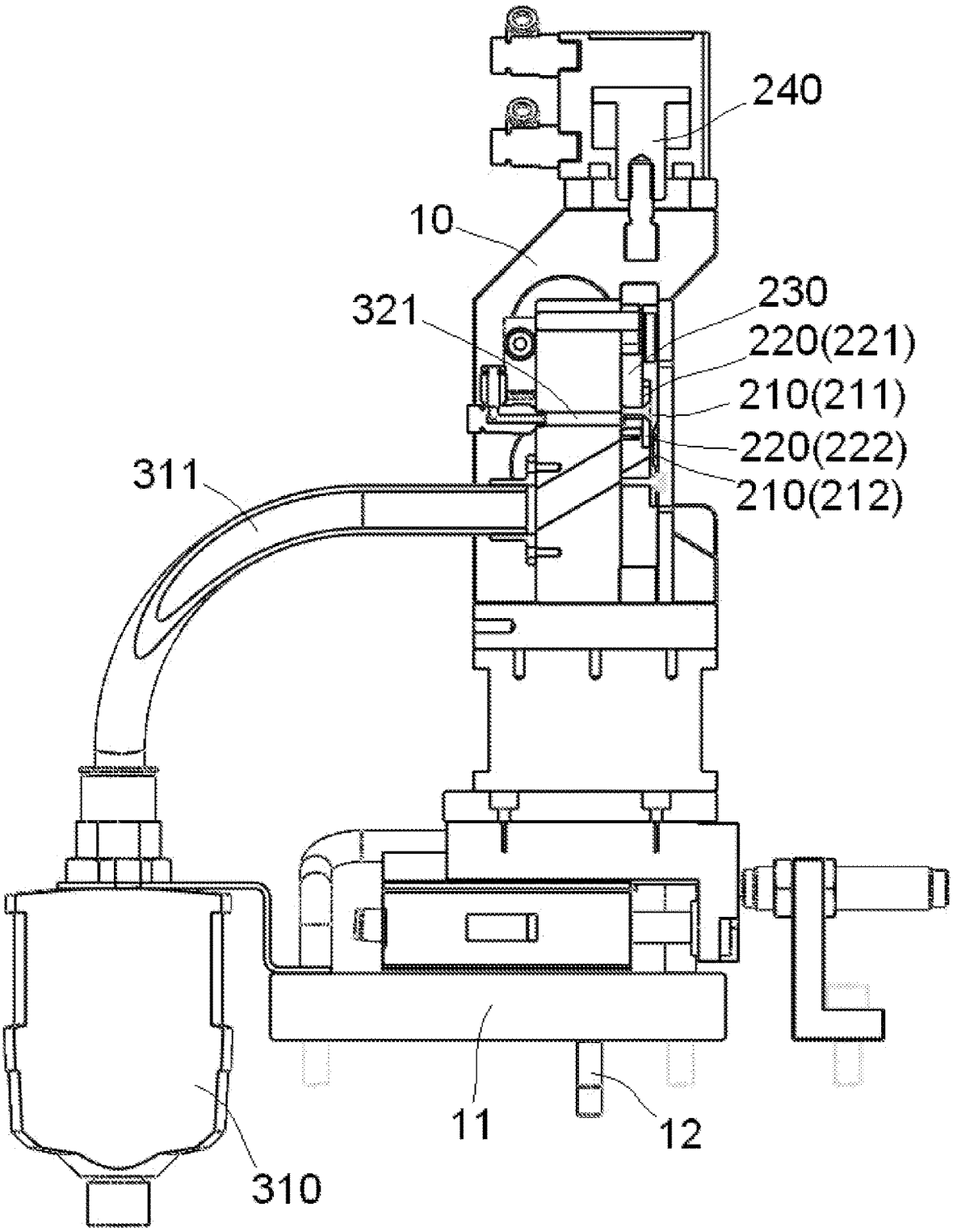
FIG. 2 is a side view of the wire processing apparatus.

A wire processing apparatus according to an embodiment is shown in FIGS. 1 and 2. The wire processing apparatus comprises a frame 10, a clamping device 100, and a straightening and cutting device 200. The clamping device 100 is mounted on the frame 10 and adapted to clamp a wire 1 to be processed. The straightening and cutting device 200 is mounted on the frame 10 and adapted to press a conductor 1*a* of the clamped wire 1, shown in FIGS. 4A and 4B, into a straight shape and cut the straightened conductor 1*a* after pressing to a predetermined length.

Figure 3:
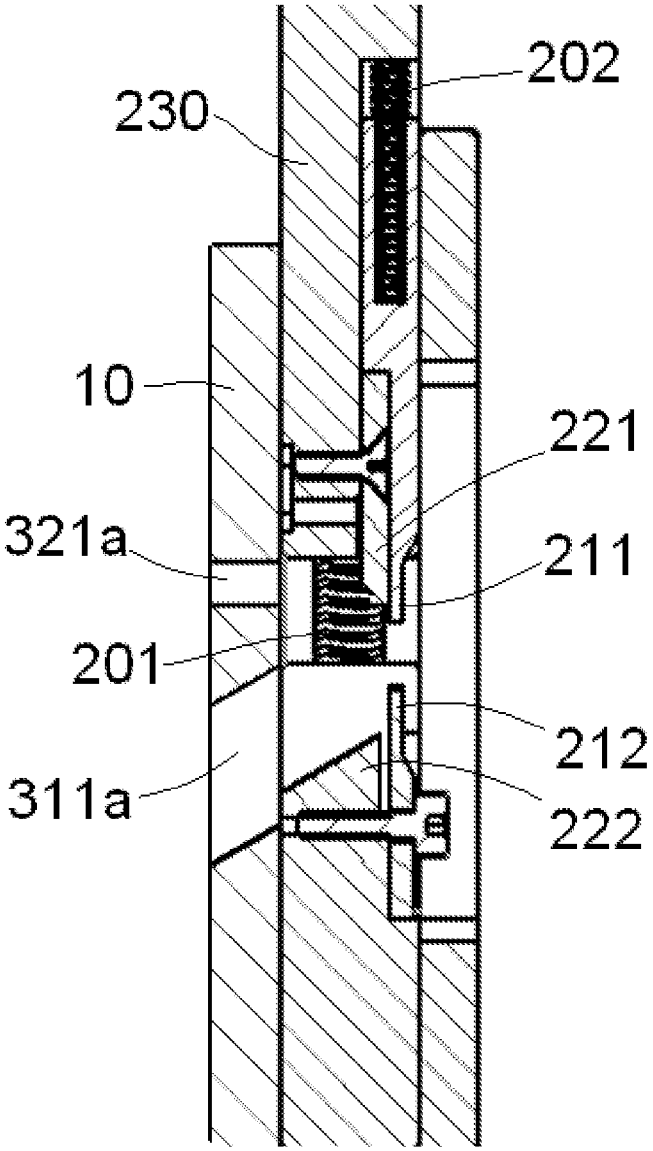
FIG. 3 is an enlarged sectional side view of a portion of the wire processing apparatus.

The straightening and cutting device 200, as shown in FIGS. 1-3, comprises a straightening die 210, a cutting tool 220, a sliding block 230, and a driving mechanism 240. As shown in FIGS. 2-3, the straightening die 210 includes an upper straightening module 211 and a lower straightening module 212 facing the upper straightening module 211. The cutting tool 220 comprises an upper cutting blade 221 and a lower cutting blade 222 facing the upper cutting blade 221. The sliding block 230 is slidably mounted on the frame 10. The driving mechanism 240 is adapted to drive the sliding block 230 to slide downward.

As shown in FIGS. 2-3, the upper straightening module 211 and the upper cutting blade 221 both are mounted on the sliding block 230, and are movable upward and downward in a vertical direction with the sliding block 230. The lower straightening module 212 and the lower cutting blade 222 are fixedly mounted on the frame 10.

The upper cutting blade 221 and the lower cutting blade 222 are offset from each other by a predetermined distance in a horizontal direction, as shown in FIG. 3, so that the upper cutting blade 221 does not collide or contact the lower cutting blade 222 during cutting the conductor 1*a*. In order to cut the conductor 1*a* of the wire 1, the predetermined distance between the upper cutting blade 221 and the lower cutting blade 222 in the horizontal direction should not be too large. In an exemplary embodiment, the predetermined distance is within a range of 1/20 to 1/5 of a diameter of the conductor 1*a* of the wire 1 to be cut. In another embodiment, the predetermined distance is equal to 1/10 of the diameter of the conductor 1*a* of the wire 1 to be cut.

The upper straightening module 211, as shown in FIGS. 2 and 3, is movably mounted in a receiving chamber formed in the sliding block 230, and a spring 202 is provided in the receiving chamber to push the upper straightening module 211 downward.

Figure 4A:
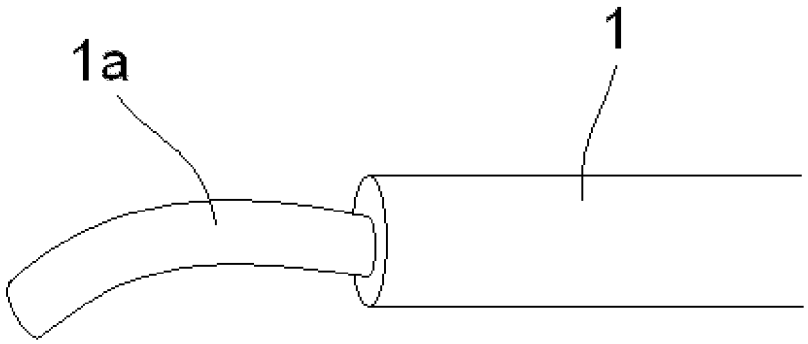
FIG. 4A is a perspective view of a wire in which a conductor exposed from an end of the wire is not straight.
Figure 4B:
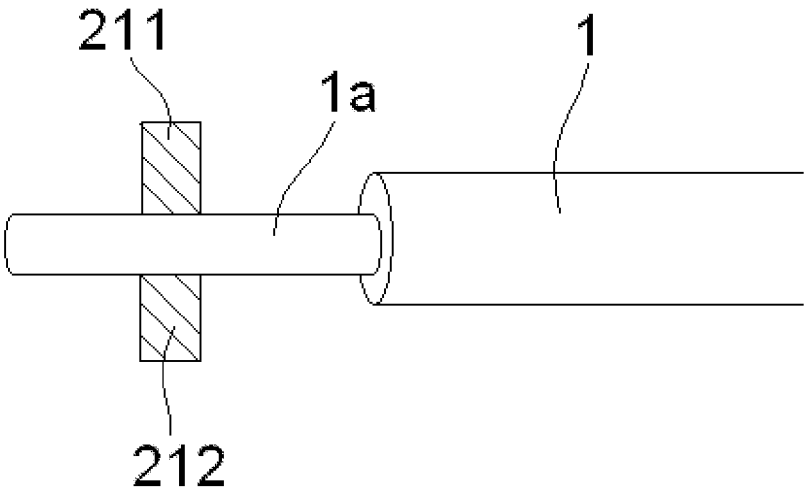
FIG. 4B is a perspective view of the wire of FIG. 4A in which the conductor is straightened.

As shown in FIGS. 3, 4A, and 4B, after the upper straightening module 211 is moved downward and into contact with the conductor 1*a* of the wire 1, as the sliding block 230 moves further downward, the spring 202 is gradually compressed to exert a downward push force to the upper straightening module 211 to press the conductor 1*a* between the upper straightening module 211 and the lower straightening module 212 into a straight shape. Before the conductor 1*a* of the wire 1 is pressed straight by the upper straightening module 211 and the lower straightening module 212, the upper cutting blade 221 does not contact the conductor 1*a* of the wire 1. After the conductor 1*a* of the wire 1 is pressed straight by the upper straightening module 211 and the lower straightening module 212, the upper cutting blade 221 comes into contact with the conductor 1*a* of the wire 1, and cuts the conductor 1*a* of the wire 1 by cooperating with the lower cutting blade 222.

The driving mechanism 240, in the embodiment shown in FIGS. 1 and 2, is an air cylinder adapted to drive the sliding block 230 to move down. In other embodiments, the driving mechanism 240 may be any other type of driving mechanism, for example, the driving mechanism 240 may comprise a motor and a transmission mechanism for converting a rotation motion of the motor into a straight line motion.

As shown in FIGS. 2 and 3, a reset spring 201 is provided on the frame 10 and adapted to push the sliding block 230 upward, so that the sliding block 230 is automatically moved up to an initial position. In this way, after the conductor 1*a* of the wire 1 is straightened and cut, the sliding block 230, as well as the upper straightening module 211 and the upper cutting blade 221, are automatically moved to the initial position by the reset spring 201, and the air cylinder of the driving mechanism 240 is simultaneously reset.

In the embodiment shown in FIGS. 1-3, the wire processing apparatus further comprises a waste collecting device 300 adapted to collect a waste material cut off from the conductor 1*a* of the wire 1. The waste collecting device 300 comprises an air blowing device and a vacuum suction device 310. The air blowing device includes an air blow pipe 321 fixed on the frame 10 and configured to blow off the waste material adhered to the cutting tool 220. The vacuum suction device 310 comprises a vacuum suction pipe 311 fixed on the frame 10 and configured to suck the waste material blown off from the cutting tool 220 into a waste container of the vacuum suction device 310.

An outlet 321*a* of the air blow pipe 321 is located near the upper cutting blade 221, as shown in FIG. 3. High pressure air output from the outlet 321*a* of the air blow pipe 321 thereby easily blows off the waste material from the cutting tool 220. A suction inlet 311*a* of the vacuum suction pipe 311 is located near the lower cutting blade 222; the waste material blown off from the cutting tool 220 is thereby easily sucked into the waste container of the vacuum suction device 310. The air blowing device and the vacuum suction device 310 are activated after the conductor 1*a* of the wire 1 has been cut off by the cutting tool 220.

The clamping device 100, as shown in FIG. 1, comprises a fixation base 110 and a pressing mechanism 120. A positioning slot adapted to position the wire 1 is formed on the fixation base 110. The pressing mechanism 120 is provided above/on the fixation base 110 and adapted to press and hold the wire 1 in the positioning slot.

The frame 10, as shown in FIGS. 1 and 2, is adapted to be detachably mounted on a seat in an embodiment. A plurality of positioning pins 12 are provided on a bottom 11 of the frame 10. The positioning pins 12 are adapted to be mated with positioning holes formed in the seat, so as to detachably mount the frame 10 on the seat.

In the wire processing apparatus according to the invention, the conductor 1*a* of the wire 1 may be automatically processed by the wire processing apparatus, improving the processing efficiency of the wire 1 and ensuring the processing quality of the wire 1.

What is claimed is:

1. A wire processing apparatus, comprising:

a frame;

a clamping device mounted on the frame and adapted to clamp a wire to be processed; and a straightening and cutting device mounted on the frame and adapted to press a conductor of the wire into a straight shape and cut the conductor to a predetermined length after pressing, comprising:

a straightening die including an upper straightening module and a lower straightening module facing the upper straightening module;

a cutting tool including an upper cutting blade and a lower cutting blade facing the upper cutting blade;

a sliding block slidably mounted on the frame; and a driving mechanism adapted to drive the sliding block, the upper straightening module and the upper cutting blade are mounted on the sliding block and are movable upward and downward in a vertical direction with the sliding block, the lower straightening module and the lower cutting blade are fixedly mounted on the frame.

2. The wire processing apparatus of claim 1, wherein the upper cutting blade and the lower cutting blade are offset from each other by a predetermined distance in a horizontal direction and the upper cutting blade does not contact the lower cutting blade during cutting the conductor.

3. The wire processing apparatus of claim 2, wherein the predetermined distance is within a range of 1/20 to 1/5 of a diameter of the conductor.

4. The wire processing apparatus of claim 3, wherein the predetermined distance is equal to 1/10 of the diameter of the conductor.

5. The wire processing apparatus of claim 1, wherein the upper straightening module is movably mounted in a receiving chamber formed in the sliding block and a spring is provided in the receiving chamber to push the upper straightening module downward in the vertical direction.

6. The wire processing apparatus of claim 5, wherein, after the upper straightening module is moved downward in the vertical direction and is brought into contact with the conductor, the spring is gradually compressed to exert a downward push force in the vertical direction to the upper straightening module to press the conductor located between the upper straightening module and the lower straightening module into the straight shape.

7. The wire processing apparatus of claim 6, wherein, before the conductor is pressed into the straight shape by the upper straightening module and the lower straightening module, the upper cutting blade is not in contact with the conductor.

8. The wire processing apparatus of claim 7, wherein, after the conductor is pressed into the straight shape by the upper straightening module and the lower straightening module, the upper cutting blade moves into contact with the conductor and cuts the conductor by cooperating with the lower cutting blade.

9. The wire processing apparatus of claim 8, wherein the driving mechanism includes an air cylinder adapted to drive the sliding block.

10. The wire processing apparatus of claim 9, further comprising a reset spring provided on the frame and adapted to push the sliding block upward in the vertical direction so that the sliding block is automatically moved up to an initial position.

11. The wire processing apparatus of claim 1, wherein the clamping device includes a fixation base on which a positioning slot adapted to position the wire is formed and a pressing mechanism provided on the fixation base and adapted to press the wire in the positioning slot.

12. A wire processing apparatus, comprising:

a frame;

a clamping device mounted on the frame and adapted to clamp a wire to be processed; and a straightening and cutting device mounted on the frame and adapted to press a conductor of the wire into a straight shape and cut the conductor to a predetermined length after pressing, comprising:

a straightening die including a first straightening module;

a cutting tool including a first cutting blade;

a sliding block slidably mounted on the frame; and a driving mechanism adapted to drive the sliding block, the first straightening module and the first cutting blade are mounted on the sliding block and are movable upward and downward in a vertical direction with the sliding block.

13. The wire processing apparatus of claim 12, further comprising a waste collecting device adapted to collect a waste material cut off from the conductor.

14. The wire processing apparatus of claim 13, wherein the waste collecting device comprises:

an air blowing device including an air blow pipe fixed on the frame and configured to blow off the waste material that is adhered to the cutting tool; and a vacuum suction device including a vacuum suction pipe fixed on the frame and configured to suck the waste material blown off from the cutting tool into a waste container of the vacuum suction device.

15. The wire processing apparatus of claim 14, wherein an outlet of the air blow pipe is located near the first cutting blade.

16. The wire processing apparatus of claim 15, wherein a suction inlet of the vacuum suction pipe is located near a second cutting blade facing the first cutting blade.

17. The wire processing apparatus of claim 12, wherein the frame is detachably mounted on a seat.

18. The wire processing apparatus of claim 17, wherein a plurality of positioning pins are disposed on a bottom of the frame and are adapted to be mated with a plurality of positioning holes of the seat to detachably mount the frame on the seat.

19. The wire processing apparatus of claim 12, wherein the first straightening module is movably mounted in a receiving chamber formed in the sliding block and a spring is provided in the receiving chamber to push the first straightening module downward in the vertical direction.

20. The wire processing apparatus of claim 19, wherein:

after the first straightening module is moved downward in the vertical direction and is brought into contact with the conductor, the spring is gradually compressed to exert a downward push force in the vertical direction to the first straightening module to press the conductor into the straight shape, and after the conductor is pressed into the straight shape, the first cutting blade moves into contact with the conductor and cuts the conductor.

* * * * *